US005903517A

United States Patent [19]

Futsuhara et al.

[11] Patent Number: 5,903,517

[45] Date of Patent: May 11, 1999

[54] MOVING BODY CONTROL APPARATUS

[75] Inventors: Koichi Futsuhara; Masayoshi Sakai, both of Urawa, Japan

[73] Assignee: The Nippon Signal Co., LTD., Tokyo, Japan

[21] Appl. No.: 08/913,186

[22] PCT Filed: Jan. 9, 1997

[86] PCT No.: PCT/JP97/00031

§ 371 Date: Sep. 8, 1997

§ 102(e) Date: Sep. 8, 1997

[87] PCT Pub. No.: WO97/25234

PCT Pub. Date: Jul. 17, 1997

[30] Foreign Application Priority Data

Jan. 9, 1996 [JP] Japan ..... 8/1682

[51] Int. Cl.[6] ..... B61L 23/34

[52] U.S. Cl. ..... 367/120; 73/636

[58] Field of Search ..... 367/99, 95, 118, 367/120, 127; 73/636

[56] References Cited

U.S. PATENT DOCUMENTS

| | | | |
|---|---|---|---|
| 4,689,995 | 9/1987 | Turbe | 73/636 |
| 5,341,683 | 8/1994 | Searle | 73/636 |
| 5,777,891 | 7/1998 | Pagano et al. | 73/636 |

FOREIGN PATENT DOCUMENTS

| | | |
|---|---|---|
| 51-37861 | 10/1976 | Japan . |
| 57-34206 | 2/1982 | Japan . |
| 63-98706 | 4/1988 | Japan . |
| 2-281178 | 11/1990 | Japan . |
| 4-362463 | 12/1992 | Japan . |
| 6-51801 | 2/1994 | Japan . |

*Primary Examiner*—Ian J. Lobo
*Attorney, Agent, or Firm*—Thelen Reid & Priest LLP

[57] ABSTRACT

The present invention relates to a moving body control apparatus wherein operating control flexibility and system maintainability are improved by carrying out moving body travel control by transfer of ultrasonic wave signals between moving bodies, without intervention of a ground apparatus. An ultrasonic wave transmission apparatus (1) is provided on one train (A), and an ultrasonic wave reception apparatus (10) and a signal processing circuit (13) are provided on another train (B). The timing of transmission and reception of ultrasonic wave signals is synchronized by timing signal generating circuits (2, 11) on the respective trains, and the ultrasonic wave signals are transmitted and received via a metal transmission medium (30). The reception side train (B) measures the transmission time for the ultrasonic wave signal by means of the signal processing circuit (13), and based on the measurement result generates information necessary for train travel control.

12 Claims, 15 Drawing Sheets

ANTENNA
20
CALIBRATION SIGNAL RECEIVING CIRCUIT
19
SECOND TIMING SIGNAL GENERATING CIRCUIT
11
12
ULTRASONIC WAVE GENERATING CIRCUIT
17
18
10
SIGNAL PROCESSING CIRCUIT
13
RECEPTION GATE CIRCUIT
16
AMPLIFIER
15
14

ANTENNA
6
CALIBRATION SIGNAL RECEIVING CIRCUIT
5
FIRST TIMING SIGNAL GENERATING CIRCUIT
2
1
ULTRASONIC WAVE GENERATING CIRCUIT
3
4

A
6
4
31
$v_A$
$\ell_A$
30
L1
Lo
B
20
14
18
31
$\ell_B$
Lo
$v_B$

MOVING BODY CONTROL APPARATUS

TECHNICAL FIELD

The present invention relates to a moving body control apparatus which sends and receives ultrasonic wave signals between moving bodies to produce information necessary for controlling travel of a moving body, to thereby carry out travel control of the moving body.

BACKGROUND ART

When controlling the operation of moving bodies, travel of the moving body is controlled so that a rear end collision or bumping between moving bodies, or a collision between an obstacle and the moving body does not occur.

If the moving body itself is to be liable for a rear end collision or bumping, then the information necessary to avoid this is; the distance in front of the moving body to another moving body (distance between moving bodies), or the distance in front of the moving body to an obstacle (for example in the case where the moving body travels along a rail, this also includes the distance to the end of the rail or to a damaged portion of the rail), the travelling speed of the moving body, and other information.

For example, taking a train as an example for describing the moving body, then with conventional train travel control systems, there is the fixed block system where the railroad track is divided into a plurality of block sections, and the presence or absence of a train is detected for each of the block sections, and the speed of the rear train is controlled corresponding to the inter-train distance (number of block sections) between a front train and the rear train, to thereby avoid a rear end collision.

The conventional fixed block system however is a centralized system which convergently detects the location of each train from the ground side. There is therefore the likelihood that for example a fault in one of the block sections will become an obstacle for the entire railroad track of the lines which include this block section. Moreover, there is the problem in that it is not easy to modify the design for the block section, and there are problems with flexibility of the operating control and with system maintainability and the like.

Moreover, with the conventional fixed block system, the train presence detection uses the fact that two rails of the block section are electrically short circuited by the train wheels. Therefore if for example the rail surface is rusty so that resistance is increased, then even though a train may be present, the short circuit between rails due to the train wheels becomes incomplete so that there is the possibility for example that the detection shows the train to be absent. Essentially therefore the contact resistance between the rails and the wheels becomes a problem from a safety management point of view. Moreover, since an electrical signal is transmitted to the rails on which the train travels for each block section, it is necessary to insulate the rails of adjacent block section pairs so that an electrical signal does not flow in from the adjacent block sections.

Furthermore, as another method of controlling travel of a moving body, there is the GPS (Global Positioning System) where the moving body detects its own position using a communication satellite. However with the GPS, in order to know the distance to another moving body (distance between moving bodies), a communication system between the moving bodies or between the moving body and the ground must be provided separately. Moreover, with a communication satellite, maintenance of the satellite is not possible.

A device for a moving body to detect its own position and speed using ultrasonic wave signals, has been proposed by one of the present inventors (Unexamined Japanese Patent Publication No. 4-362463). However with this device, travel of respective moving bodies is controlled by having a relationship between adjacent moving bodies. Moreover, there is no generation of information necessary for travel control.

The present invention takes into consideration the above-mentioned situations, with the object of providing a moving body control apparatus with good operating control flexibility and system maintainability, by having a decentralized control system wherein by transfer of ultrasonic wave signals between moving bodies, information for moving body travel control is generated only between moving bodies without intervention from the ground side.

DISCLOSURE OF THE INVENTION

Accordingly, with the moving body control apparatus according to the present invention, which carries out transfer of signals of ultrasonic wave or vibration between moving bodies via a metal body transmission medium to thereby carry out travel control of a moving body, an ultrasonic wave transmitting device incorporating a transmitter for radiating an ultrasonic wave signal towards the transmission medium is provided on one moving body, and an ultrasonic wave receiving device incorporating a receiver for receiving an ultrasonic wave signal via the transmission medium, and an information generating device for generating information necessary for travel control of a moving body based on the received ultrasonic wave signal are provided on an other moving body.

With such a construction, when the other moving body receives the ultrasonic wave signal sent via the transmission medium from the one moving body, then the information generating device generates the information necessary for travel control of the moving body using the received ultrasonic wave signal. In this way, by controlling the travel of the mutual moving bodies with the generated information, mutual travel of the moving bodies can be controlled with only the moving bodies and without any relation with the ground side.

Moreover, the construction may be such that the transmitter of the ultrasonic wave transmitting device and the receiver of the ultrasonic wave receiving device are each respectively mounted with a transmitting face and a receiving face in direct contact with a mechanical element of a metal body which is in direct contact with the transmission medium of the respective moving bodies.

With such a construction, since the transmission path of the ultrasonic wave is through a metal body, the transmission speed of the ultrasonic wave is faster than the propagation speed through air, and hence a drop in the sensitivity of the ultrasonic wave signals being transmitted and received between the moving bodies can be prevented. Moreover, since the transmission speed is fast, the speed of processing the control information is fast.

Furthermore, the construction may be such that there is provided a synchronizing device for synchronizing the ultrasonic wave transmitting device and the ultrasonic wave receiving device with each other.

With such a construction, the transmission time of the ultrasonic wave can be measured accurately.

Moreover, there may be provided a calibration device for respectively calibrating any deviation in synchronization of respective timing signals of first and second timing signal generating devices.

With such a construction, any deviation in synchronization between the transmission side and the reception side can be prevented, and hence the accuracy of the generated control information can be improved and reliability increased.

Moreover, the construction may be such that the information generating device comprises a relative speed computing device for computing a relative velocity between moving bodies based on a change pattern for the distance between moving bodies computed by a distance computing device.

With such a construction, distance information and relative speed information between the moving bodies can be obtained.

Moreover, the construction may be such that the other moving body incorporates an other ultrasonic wave transmitting device separate from the ultrasonic wave transmitting device of the one moving body, the information generating device incorporates a reception side speed computing device for computing the speed of the other moving body on the reception side, based on a time from transmission of an ultrasonic wave signal from the other ultrasonic wave transmitting device until reception by the ultrasonic wave receiving device, and the distance between the moving bodies is computed based on a computed value of the reception side speed computing device and a measured value of a time measuring device.

With such a construction, the speed information for computing the distance between the moving bodies can be obtained to a high accuracy, and hence the accuracy of detecting the distance between the moving bodies can also be improved.

The construction may be such that the information generating device incorporates a transmission side speed computing device for computing the speed of the one moving body on the transmission side based on a relative speed computed by the relative speed computing device and a speed of the other moving body computed by the reception side speed computing device.

With such a construction, moving body speed information on the other side can be obtained.

The construction may be such that the ultrasonic wave transmitting device of one moving body and the ultrasonic wave receiving device of the other moving body are not synchronized.

More specifically the two moving bodies may each incorporate an ultrasonic wave transmitting device and an ultrasonic wave receiving device, the construction being such that when the ultrasonic wave receiving device on the one moving body side receives an ultrasonic wave signal transmitted from the other moving body side then without delay, the ultrasonic wave signal is sent back to the other moving body side, and the sent back signal is received by the ultrasonic wave receiving device on the other moving body side, and the information generating device generates the information necessary for travel control of a moving body based on the time from when the ultrasonic wave is transmitted from the other moving body side until the sent back signal is received on the other moving body side.

With such a construction, the side which first transmits the ultrasonic wave signal receives the sent back signal from the moving body on the other side and generates information based on the time from transmission until reception. Therefore processing for generating information can be executed without any relation to the processing operation of the moving body on the other side. Hence the signal processing operations of the respective moving bodies can be non synchronous. There is thus no requirement for a synchronizing device and hence the apparatus can be simplified.

The construction may be such that the other moving body incorporates a transmission device for transmitting travel control information to the other side moving body based on information generated by the information generating device, and the one moving body incorporates a control device for generating travel control commands based on travel control information transmitted by the transmission device.

With such a construction, the travel conditions of the transmission side moving body of the other side can be controlled by the ultrasonic wave signal reception side moving body.

With the moving body control apparatus according to the invention, the moving bodies may be trains, and the transmission medium may be a rail on which the trains travel.

With such a construction, then instead of the centralized train control system using the conventional fixed block system, travel of the respective trains can be controlled with only information communication between trains. Hence a decentralized train control system with good train operating control flexibility and good maintainability can be realized.

[31]

BEST MODE FOR CARRYING OUT THE INVENTION

As follows is a description of a moving body control apparatus according to the present invention, with reference to the appended drawings.

FIG. 1 through FIG. 8 show a first embodiment of the present invention, illustrating a case where this is applied to travel control of a train.

The moving body control apparatus of this embodiment comprises an ultrasonic wave transmission side apparatus mounted on one moving body and an ultrasonic wave reception side apparatus mounted on an other moving body.

Figures 1A, 1B:
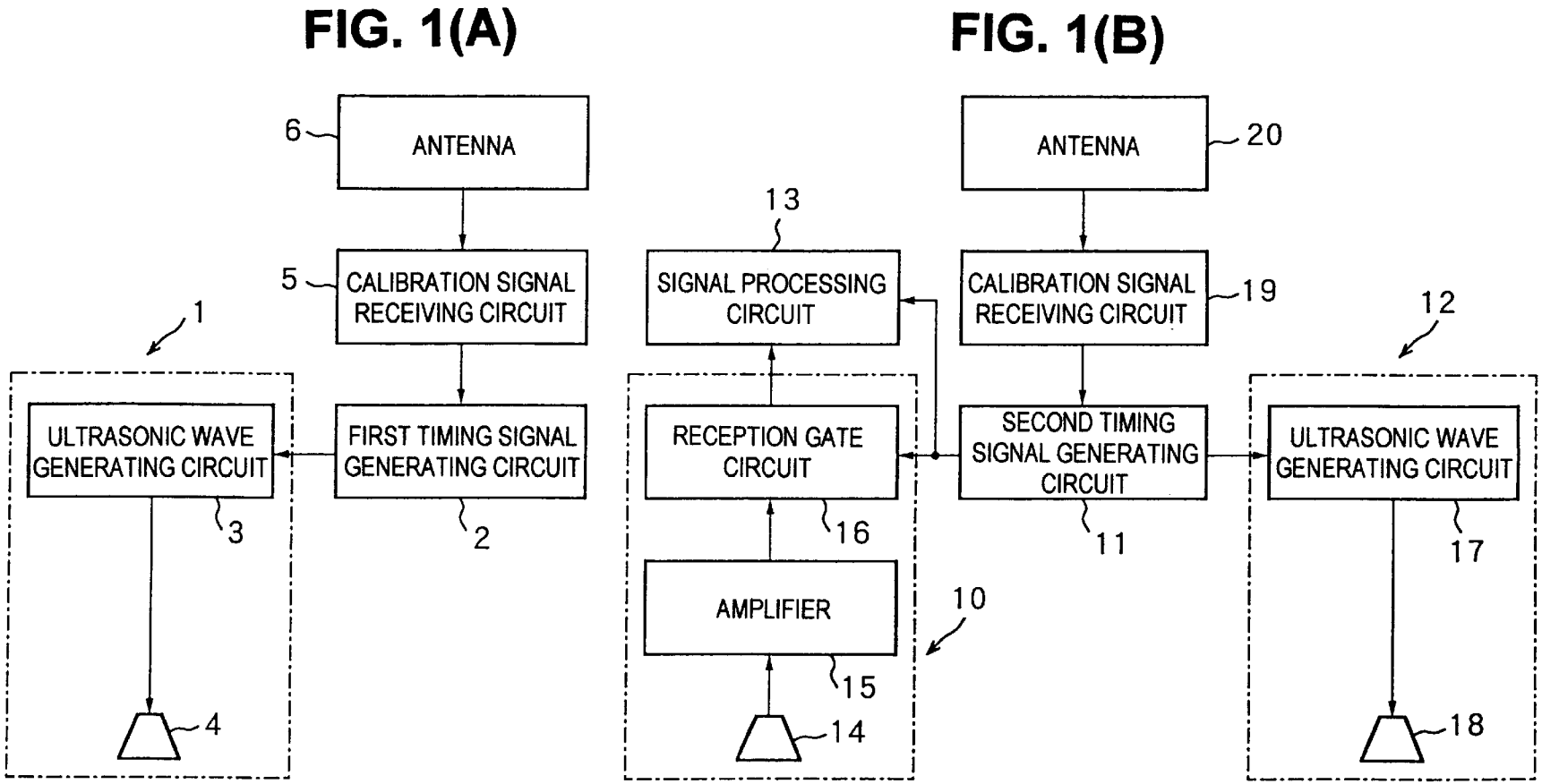
FIG. 1 is a schematic diagram of a control apparatus of a first embodiment according to the present invention, (A) being a schematic diagram of a transmission side apparatus, and (B) being a schematic diagram of a reception side apparatus.

FIG. 1(A) shows the transmission side apparatus. The transmission side apparatus comprises; an ultrasonic wave transmission apparatus 1 serving as an ultrasonic wave transmitting device, a first timing signal generating circuit 2 serving as a first timing signal generating device, a calibration signal receiving circuit 5 for receiving a calibration signal for periodically calibrating synchronization of the first timing signal generating circuit 2 and a later described second timing signal generating circuit 11, and an antenna 6 for receiving on the train, the calibration signal from a calibration signal generating source (not shown in the figure) for example from the ground side, and inputting this to the calibration signal receiving circuit 5. The ultrasonic wave transmission apparatus 1 comprises an ultrasonic wave generating circuit 3 and a transmitter 4.

Figure 2:
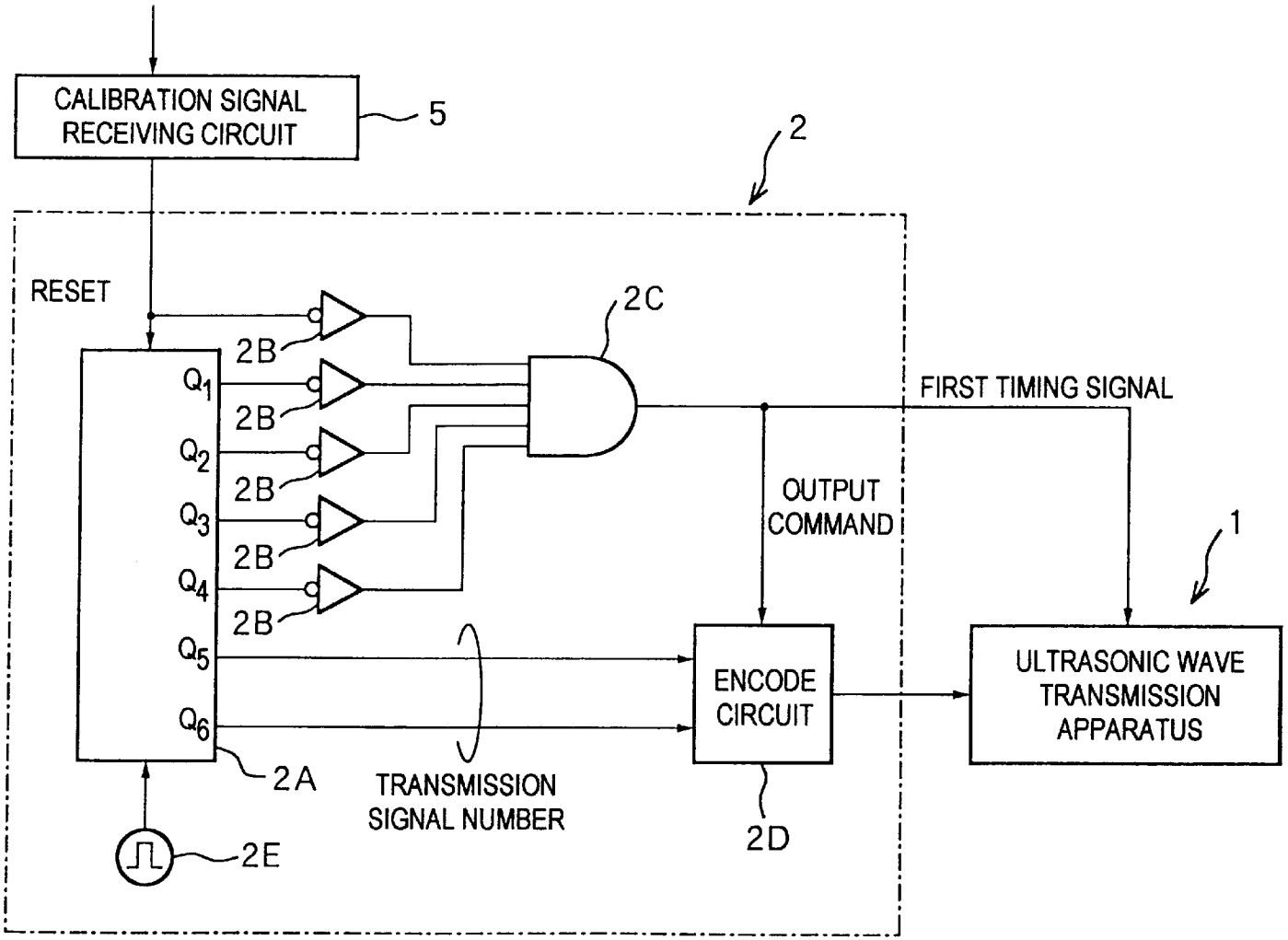
FIG. 2 is a schematic diagram of a transmission side timing signal generating circuit of the first embodiment.

The first timing signal generating circuit 2 controls the generation timing of the ultrasonic wave from the ultrasonic wave generating circuit 3, and is constructed for example as shown in FIG. 2.

In FIG. 2, the first timing signal generating circuit 2 comprises; a counter 2A, a plurality of NOT circuits 2B, an AND circuit 2C, an encode circuit 2D, and a clock signal generator 2E.

Figure 3:
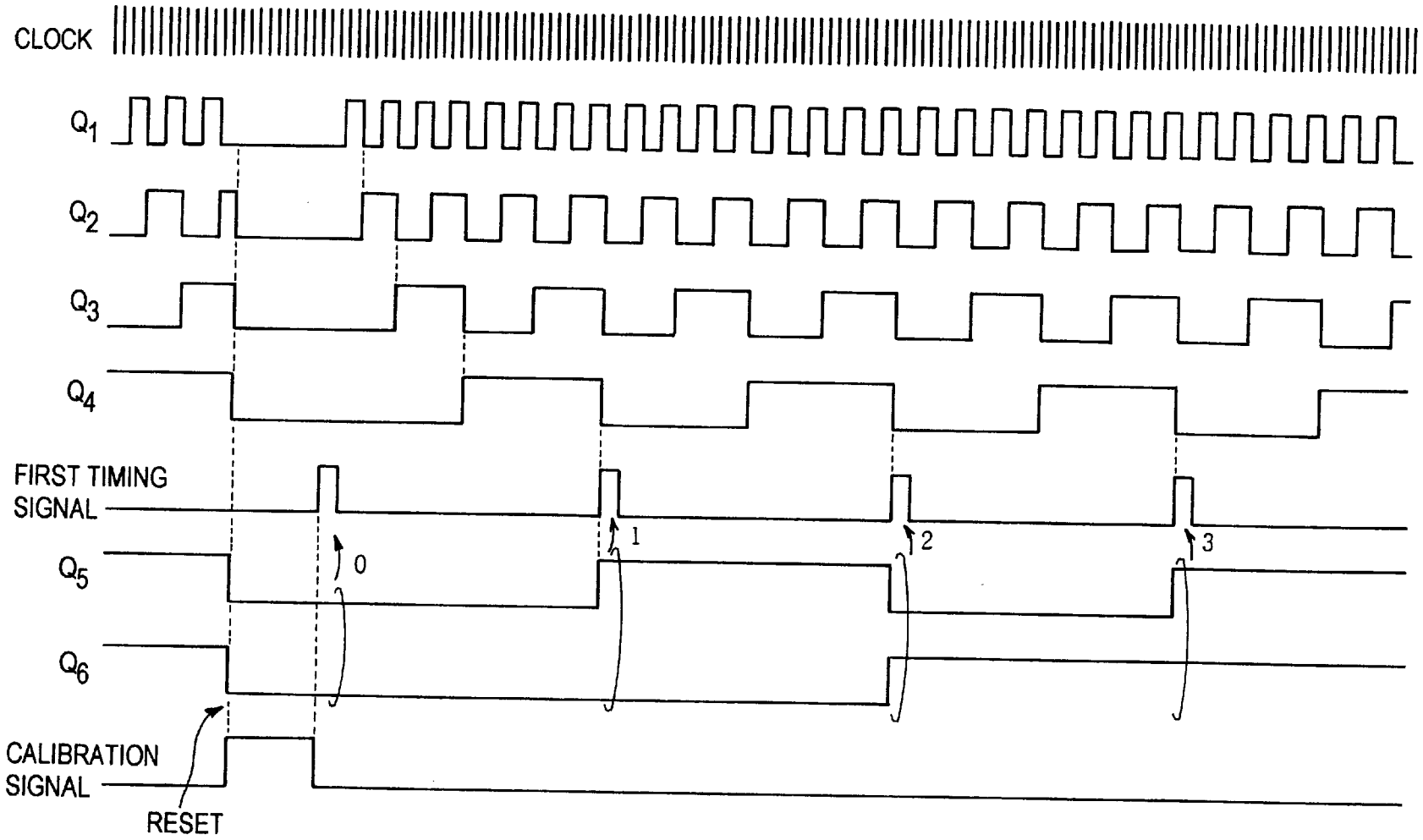
FIG. 3 is a time chart for the circuit of FIG. 2.

With the operation, as shown by the time chart of FIG. 3, a clock signal from the clock signal generator 2E is frequency divided by the counter 2A, the counter 2A generating six frequency divided output signals $Q_1$~$Q_6$. When $Q_1=Q_2=Q_3=Q_4=0$, and under the proviso that there is no input of a calibration signal, a first timing signal is generated from the AND circuit 2C and output to the ultrasonic wave transmission apparatus 1. That is to say, the first timing signal is generated at a period of the frequency divided output signal $Q_4$ and the ultrasonic wave signal transmitted. Moreover, the frequency divided output signals $Q_5$, $Q_6$ are signals for appending transmission signal numbers $N_S$ (shown as 0, 1, 2, 3 . . . in FIG. 3) for indicating the order of the transmitted ultrasonic wave signals. They are coded by the encode circuit 2D and transmitted by the input of the first timing signal (output command in FIG. 2). The later described calibration for deviation in synchronization to the reception side, is carried out as shown in FIG. 3 by forcibly resetting to zero all the six frequency divided output signals $Q_1$~$Q_6$ when the calibration signal is input from the calibration signal receiving circuit 5 (at the rising edge of the calibration signal), and restarting the counting operation when input of the calibration signal ceases (at the falling edge of the calibration signal).

With the present embodiment, the frequency divided output signal $Q_1$ is a half frequency signal of the clock signal. However this need not necessarily be a half frequency of the clock signal.

FIG. 1(B) shows the reception side apparatus. The reception side apparatus comprises; an ultrasonic wave reception apparatus 10 serving as an ultrasonic wave receiving device, a second timing signal generating circuit 11 serving as a second timing signal generating device, constituting with the first timing signal generating circuit 2, a synchronizing device, an ultrasonic wave transmission apparatus 12 serving as an ultrasonic wave transmitting device, a signal processing circuit 13 serving as an information generating device for generating information necessary for travel control of a moving body based on received ultrasonic wave signals, a calibration signal receiving circuit 19 for receiving a calibration signal for periodically calibrating synchronization of the second timing signal generating circuit 11 and the transmission side first timing signal generating circuit 2, and an antenna 20 for receiving on the train, the calibration signal from the calibration signal generating source, and outputting this to the calibration signal receiving circuit 19. The ultrasonic wave reception apparatus 10 comprises; a receiver 14, an amplifier 15 and a reception gate circuit 16. Moreover, the ultrasonic wave transmission apparatus 12 comprises; an ultrasonic wave generating circuit 17 and a transmitter 18. The second timing signal generating circuit 11 outputs a second timing signal synchronized with the first timing signal generating circuit 2 on the transmission side apparatus to the reception gate circuit 16, the ultrasonic wave generating circuit 17, and the signal processing circuit 13. With the reception gate circuit 16, the gate is opened with input of the second timing signal, thereby preventing the influence of noise, apart from that necessary at the time of receiving the transmission wave. The signal processing circuit 13 measures the transmission time of the ultrasonic wave as described hereunder, based on the second timing signal input thereto, to compute the speed of the reception side moving body itself and the distance between the transmission side and the reception side moving bodies. The time measuring device thus incorporates the function of a distance computing device and a reception side speed computing device. Moreover, the calibration signal generating source, the antennas 6, 20 and the calibration signal receiving circuits 5, 19 constitute the calibration device.

Figure 4:
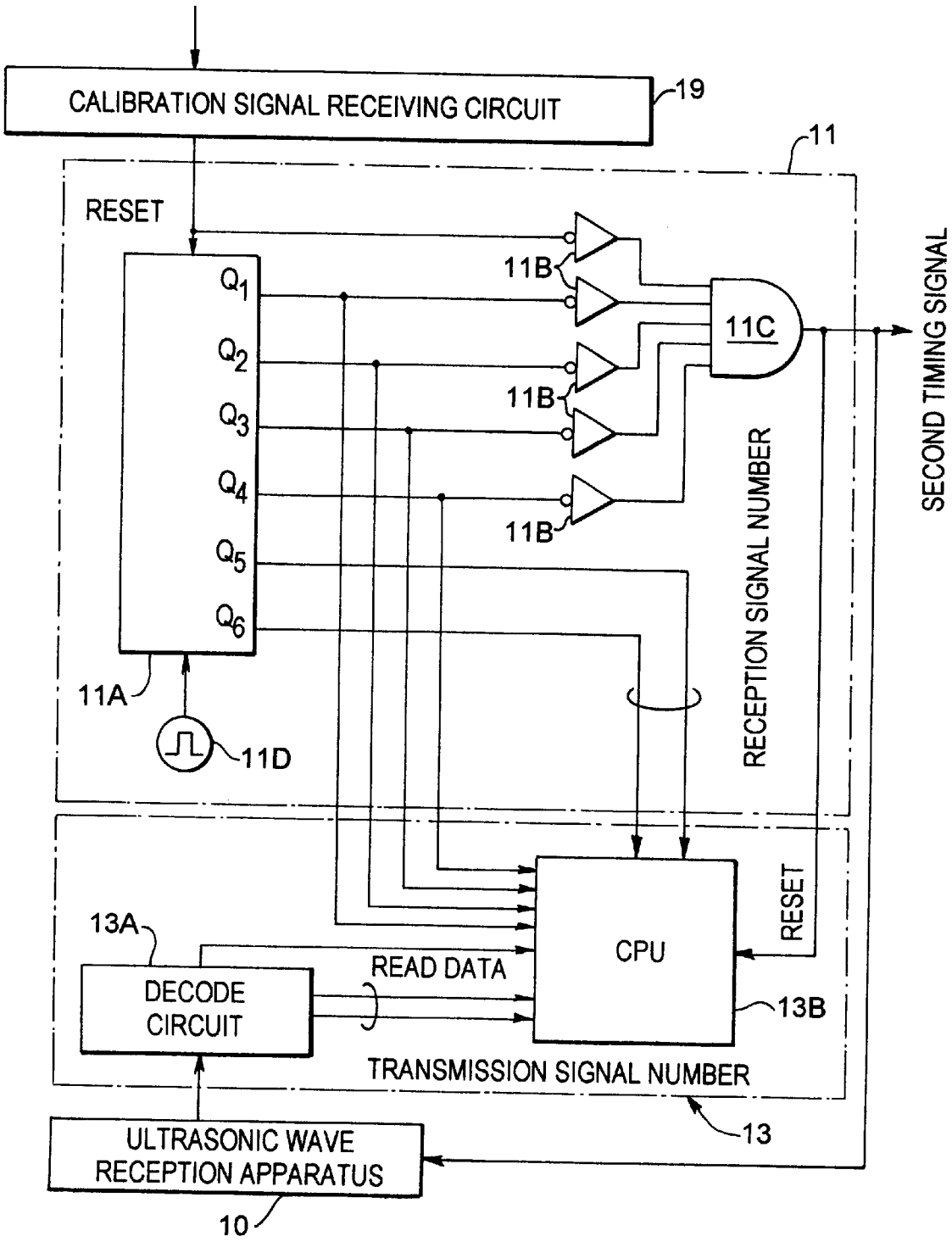
FIG. 4 is a schematic diagram of a reception side timing signal generating circuit and a signal processing circuit of the first embodiment.

FIG. 4 shows a circuit configuration of the second timing signal generating circuit 11 and the signal processing circuit 13.

In FIG. 4, the second timing signal generating circuit 11 is configured almost the same as the first timing signal generating circuit 2, comprising a counter 11A, a plurality of NOT circuits 11B, an AND gate 11C, and a clock signal generator 11D.

The operation of the counter 11A is the same as for the counter 2A of the first timing signal generating circuit 2, and hence description is omitted. The output signals $Q_5$, $Q_6$ from the counter 11A are for appending the reception signal numbers $N_R$ to the reception signals. With the second timing signal generating circuit 11, the frequency divided output signals $Q_1$~$Q_4$ of the counter 11A give the time of receipt of the transmitted ultrasonic wave.

With the signal processing circuit 13, the data of the received signal received by the ultrasonic wave reception apparatus 10 is read by a CPU 13B via a decode circuit 13A. The transmission time of the ultrasonic wave is then measured and the measured value is used, as described later, to generate information necessary for train travel control.

Figure 5:
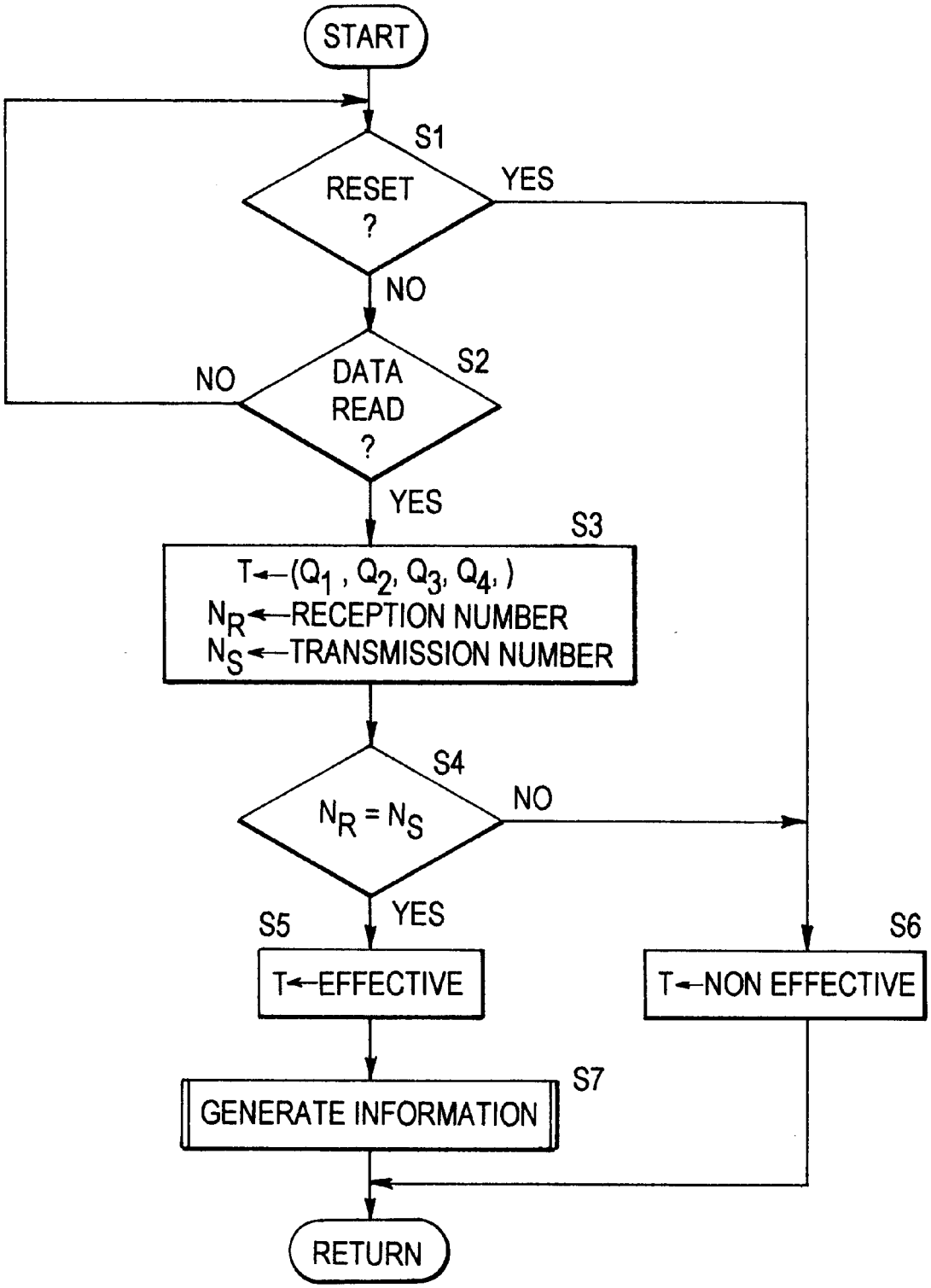
FIG. 5 is a flow chart for explaining the operation of the signal processing circuit.

Next is a description of the operation of the signal processing circuit 13, with reference to the flow chart of FIG. 5.

In step S1, it is judged if there has been reset by judging if the second timing signal has been input. If not reset conditions, then in step S2 it is judged if data has been read. If data has been read, then in step S3, the frequency divided output signals $Q_1$~$Q_4$ are read and a measurement time obtained. Moreover, with the reception signal number data appended at the reception side as $N_R$ and the transmitted transmission signal number data as $N_S$, then in step S4 it is judged if $N_R=N_S$. Here when $N_R=N_S$, then in step S5, the data for measurement time T is made effective and in step S7, computation of the information necessary for train travel control is executed based on the measurement time data.

In the case where an excessive deviation from synchronism occurs at the transmission side and reception side, then a large deviation occurs in the time being measured. In this case, the transmission signal number $N_S$ received on the reception side differs from the reception signal number $N_R$ expected to be received on the reception side. Consequently $N_R \neq N_S$, and hence the judgment in step S4 becomes NO, and control proceeds to step S6 where the measurement time T is made non effective. In this way, the reliability of the measurement of the transmission time is improved.

Figure 6:
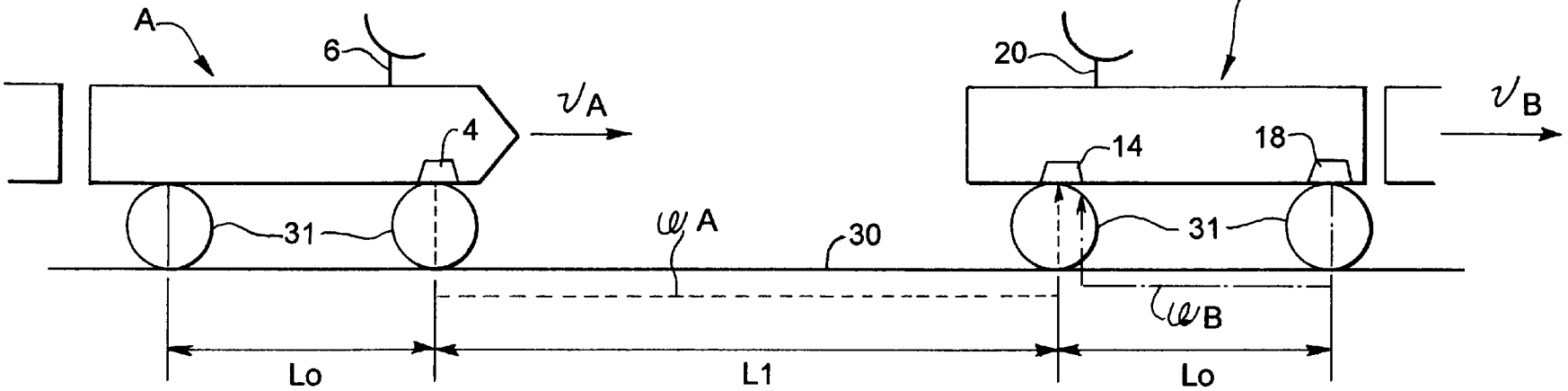
FIG. 6 is a diagram for explaining the operation of the first embodiment.

The transmission side apparatus shown in FIG. 1(A), is located as shown in FIG. 6 at the foremost pointed end of the rear train A (one moving body), while the reception side apparatus shown in FIG. 1(B), is located as shown in FIG. 6 at the rearmost part of the front train B (other moving body). The transmission side apparatus may instead however be mounted on the rearmost part of the front train B, and the reception side apparatus mounted on the foremost pointed end of the rear train A.

Figure 7:
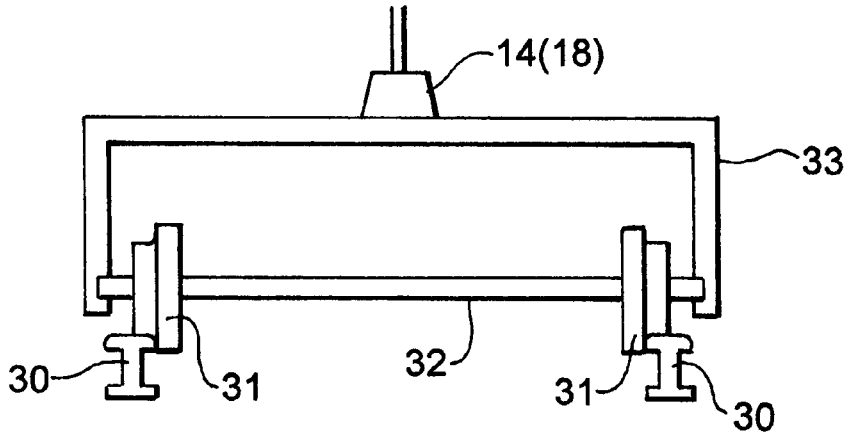
FIG. 7 is a diagram illustrating a mounting configuration for a transmitter and a receiver.
Figure 8:
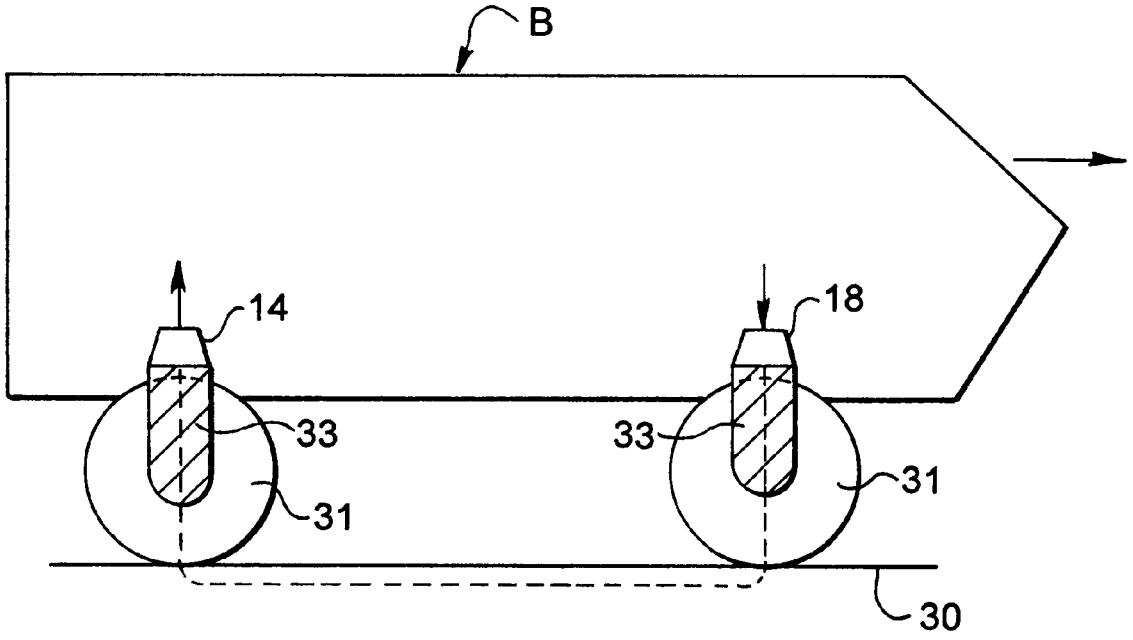
FIG. 8 is a view of FIG. 7 as seen from the side.

The respective transmitter 18 and the receiver 14 are mounted as shown in FIG. 7 and FIG. 8, to the respective trains A and B (FIG. 7 and FIG. 8 show an example of the mounting of the transmitter and receiver). That is to say, an axle 32 connecting between wheels 31 which rotate on a rail 30 serving as a transmission medium on which the trains A and B travel, is axially supported by an approximate rectangular axle support member 33, and the transmitter 18 and the receiver 14 are directly mounted on an approximately central upper face of the axle support member 33 with their respective ultrasonic transmission and reception faces contacted therewith. The axle 32 and the axle support member 33 are metal bodies and constitute mechanical elements which give a direct sound coupling to the wheels 31. Consequently the transmitter 18 and the receiver 14 transmit ultrasonic waves to or receive ultrasonic waves from the rail 30 via mechanical elements comprising metal bodies.

With a construction where only the wheels 31 rotate and the axle 32 does not rotate, then the transmitter and the receiver may be mounted on the axle 32.

In FIG. 7 and FIG. 8, the train B side is shown, however the transmitter 4 on the train A side is also directly mounted in the same way on the axle support member of the train A.

Next is a description of the operation for measuring the distance between the trains A and B, in the present embodiment.

On the train A side, when the first timing signal from the first timing signal generating circuit 2 is input to the ultrasonic wave generating circuit 3, an ultrasonic wave signal is generated from the ultrasonic wave generating circuit 3, and transmitted from the foremost pointed end of the train A via the transmitter 4 to the rail 30. An ultrasonic wave signal $\omega_A$ transmitted to the rail 30, as shown by the dotted line in FIG. 6, is received by the receiver 14 at the rearmost part of the front train B, and amplified by an amplifier 15. Since as mentioned before, the second timing signal from the second timing signal generating circuit 11 which is synchronized with the generation of the first timing signal is generated simultaneously with the generation of the first timing signal so that the gate of the reception gate circuit 16 is in the open condition, then the amplified ultrasonic wave signal is input to the signal processing circuit 13 via the reception gate circuit 16.

Figure 9:
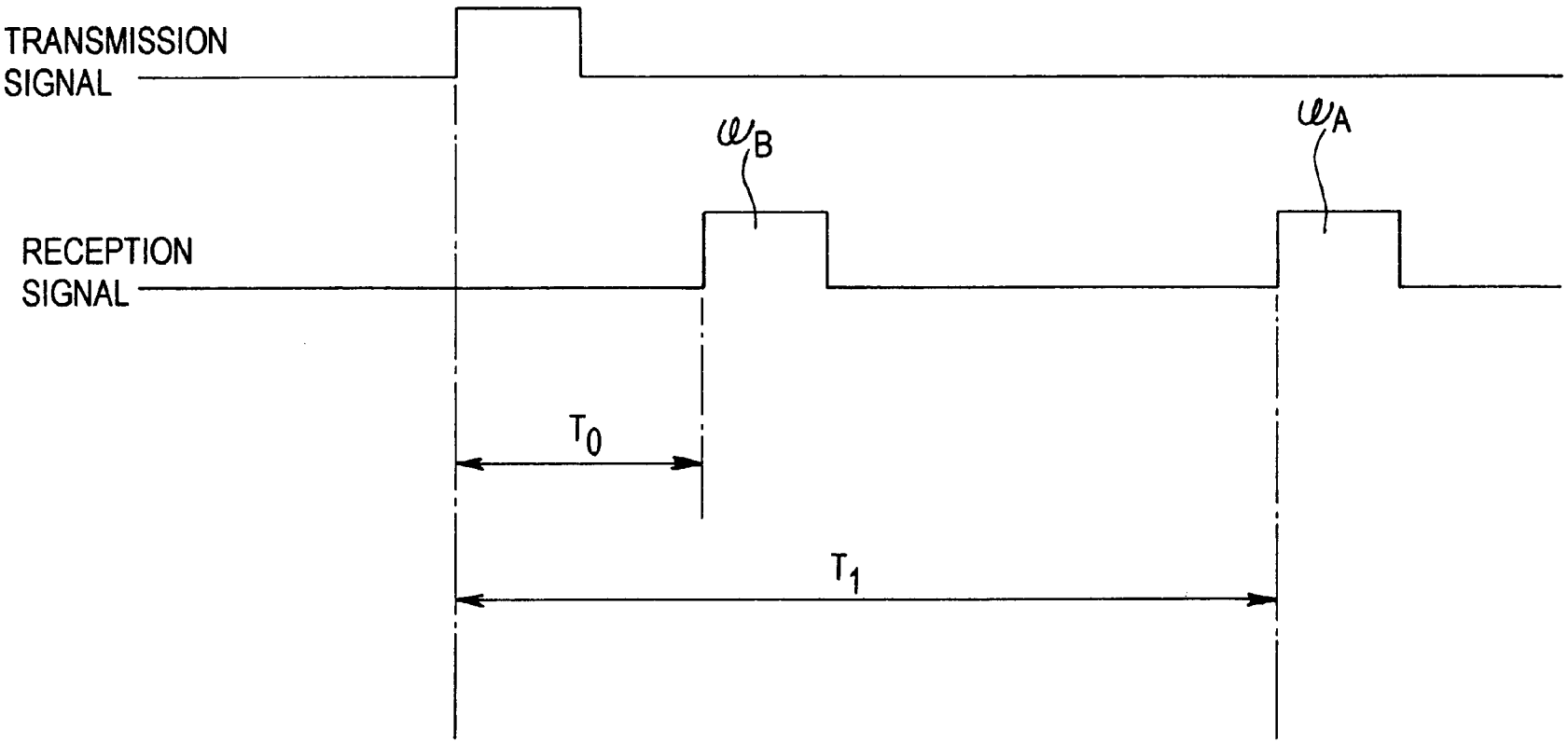
FIG. 9 is a time chart for the operation of the signal transmission and reception in the first embodiment.

Moreover, due to the second timing signal which is generated simultaneously with the first timing signal, then an ultrasonic wave signal is also generated from the ultrasonic wave generating circuit 17 on the train B side, and transmitted to the rail 30 via the transmitter 18. This ultrasonic wave signal $\omega_B$ shown by the chain line in FIG. 6 is also received by the receiver 14 and input to the signal processing circuit 13 via the amplifier 15 and the reception gate circuit 16. The time chart for reception of the ultrasonic wave signals $\omega_B$, $\omega_A$ is shown in FIG. 9.

With the signal processing circuit 13, the time from transmission of the two ultrasonic wave signals $\omega_B$, $\omega_A$ until reception is measured as mentioned before, based on the second timing signal of the second timing signal generating circuit 11. If the measured time is effective, then the distance between the trains A and B, and the speed of the train B are computed as the information necessary for train travel control.

A description of the computational processing executed by the signal processing circuit 13 is given below.

At first, the speed $v_B$ of the train B is found from the transmission time To of the ultrasonic wave signal $\omega_B$.

The transmission time To of the ultrasonic wave signal $\omega_B$ is given by the following equation:

$$To=[(Lo-v_B \cdot To)/C]+[(X_1+X_2)/C'] \quad (1)$$

Here Lo is the mounting distance between the receiver 14 and the transmitter 18 on the train B side, $X_1$ is the distance between the receiver 18 and the rail 30 (the distance from the axle support member 33 to the axle 32 to the wheel 31 and then to the rail 30), $X_2$is the distance between the receiver 14 and the rail 30 (the distance from rail 30 to the wheel 31 to the axle 32 and then to the axle support member 33), C is the propagation speed of the ultrasonic wave signal through the rail 30, C' is the propagation speed of the ultrasonic wave signal through the support member of the transmitter 18 and the receiver 14.

The propagation speeds C, C' are both propagation speeds through a metal member and hence are approximately equal. Hence if the relation between the distance Lo and the distances $X_1$, $X_2$ is $Lo >> X_1$, $X_2$, then equation (1) can be approximated by the following equation (2):

$$To \approx (Lo - v_B \cdot To)/C \quad (2)$$

Here the propagation speed C in a metal body, for example in the case where steel is used for the rail 30 and the axle support member 33, is approximately 3 km/s for a transverse wave (Electrical Engineers Pocket Book, Society of Electrical Engineers, published by Ohm Co. 1987).

Consequently since the distance Lo and the propagation speed C are known, then by measuring the transmission time To, the speed $v_B$ of the train B can be found from the following equation (3):

$$v_B \approx (Lo - To \cdot C)/To \quad (3)$$

In the case where, in contrast to the present embodiment, the transmission side apparatus is mounted on the front train B, and the reception side apparatus is mounted on the rear train A, then with the train A, the receiver 14 is positioned at the location of the transmitter 4 of FIG. 6 (the tip end of the train), and the transmitter 18 is positioned at the rear wheel 31 (separated as shown in FIG. 6 by the distance Lo from the front wheel 31). In the case where the speed is measured on the train A side, if the speed of the train A is $v_A$ then:

$$v_A \approx (To \cdot C - Lo)/To \quad (3)'$$

Next, with the transmission time $T_1$ of the ultrasonic wave signals $\omega_A$ from the train A, if the distances $X_1$, $X_2$ between the rail and the transmitter and receiver is very short compared to the distance $L_1$ between the trains A, B so that the transmission time between the rail and the transmitter and receiver can be ignored, then the transmission time $T_1$ is given by the following equation (4):

$$T1 = (v_B \cdot T_1 + L_1)/C \quad (4)$$

where, $L_1$ is the distance between the trains A and B when transmission of the ultrasonic wave signal $\omega_A$ from the train A is started.

Hence $L_1$ is given by the following equation (5):

$$L_1 = T_1(C - v_B) \quad (5)$$

Since the speed $v_B$ of the train B can be calculated from equation (3), then by measuring the transmission time $T_1$, the distance between the trains A and B can be measured.

For the speed $v_B$ of the train B, a value detected by a speedometer may be used. In this case, the ultrasonic wave transmission apparatus 12 of the train B can be omitted. However, with a speed detector which uses for example a tachometer generator there is the possibility of an error if slipping occurs between the wheel and the rail. In contrast to this, in the case as with the present embodiment, where the train speed is computed from the ultrasonic wave propagation time, there is no worry about the occurrence of an error attributable for example to slipping between the wheel and the rail.

As described above, the ultrasonic wave signal is transmitted from the rear train A to the front train B, or conversely the ultrasonic wave signal is transmitted from the front train B to the rear train A, and the transmission time is measured from the resultant received signal. Then based on this measured value, the train speed on the reception side and the distance between the trains A, B can be measured. Travel control of the train is then possible based on the speed and distance information. For example if the ultrasonic wave is transmitted from the front train to the rear train, then the distance from the front train can be directly known at the rear train side, and the rear train can control its own travelling while verifying the distance to the front train.

Consequently, travel control of the trains is possible with only the transfer of signals between trains during travelling, without a centralized control where the travel conditions between the respective trains are held on the ground side. Therefore even if a system fault occurs in one train, the influence on the trains over the whole line is small compared to with the conventional fixed block system. Moreover maintenance is also simplified if compared to modifications and the like to the conventional block section. Consequently from the point of operating control of the train, flexibility is excellent. Moreover, maintainability is also excellent. Furthermore, it is not necessary to set up block sections as with the conventional fixed block system, nor is it necessary to carry out insulation treatment of the rails 30 for each block section. Moreover, since there is no relation to the contact resistance between the wheels and the rails, trains can be accurately detected even with an increase in the contact resistance due to rust or the like on the surface of the rails.

Furthermore, with the present embodiment, the transmitters 4, 18 and the receiver 14 are directly mounted on the metal axle support member 33 which is connected to the wheels 31. Therefore compared to the case as with the beforementioned ultrasonic wave transmission and reception apparatus disclosed in Japanese Unexamined Patent Publication No. 4-362463 where the transmitter and the receiver are mounted beneath the vehicle facing towards the rail and the ultrasonic wave is radiated through the air towards the rail, any drop in the sensitivity during distance measurement using the propagation time of the ultrasonic wave signal can be prevented. Moreover, compared to the case where the sound is propagated through the air, the influence of wind can be avoided.

As follows is a discussion concerning the reasons for the above.

Figure 10:
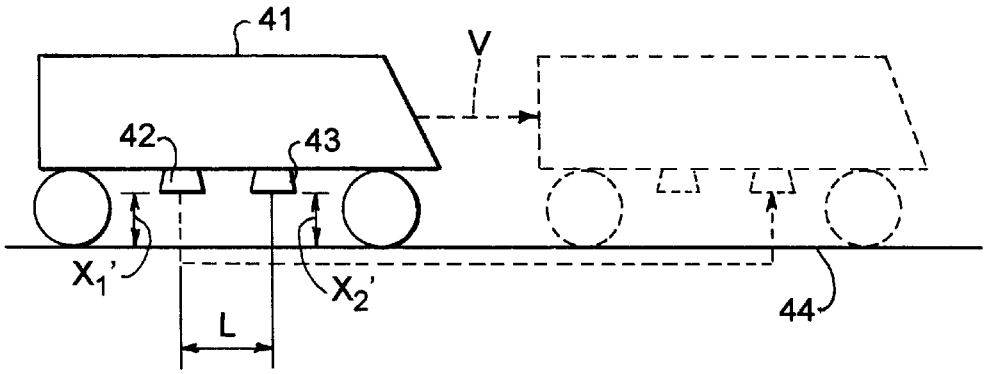
FIG. 10 is a diagram for explaining the difference in the effect of the transmitter and receiver installation arrangement for the present embodiment and the conventional construction.

With the example shown in FIG. 10, a transmitter 42 and a receiver 43 are installed on a train 41 and an ultrasonic wave signal is radiated through the air towards a rail 44.

In this case, if the respective distances $X_1'$, $X_2'$ between the rail 44 and the transmitter 42 and the receiver 43 are large, then the transmission losses therebetween become large so that the possible transmission distance of the ultrasonic wave is shortened. Moreover, since the propagation speed of sound through steel (rail 44) is approximately 3 km/s, while the propagation speed through air is slower at approximately 1/10th of that through steel, then if for example the propagation distance through the rail 44 is 10 times the propagation distance through the air ($X_1'$, $X_2'$), approximately half of the time required for the transmission and reception is taken up by the propagation through the air. That is to say, the sensitivity at the time of measuring the distance from the transmission point to the reception point using the propagation time is reduced to approximately half.

More specifically, the distance between the rail 44 and the transmitter 42 and the receiver 43 is respectively $X_1'$, $X_2'$, and the distance between the transmitter and the receiver is L. In this case, the propagation path of the ultrasonic wave is from the transmitter 42 through the air ($X_1'$) to the rail 44 and then through the air ($X_2'$) to the receiver 43.

If the transmission time from the start of transmission until reception is T, then the transmission time T is given as follows:

$$T=[(V\cdot T+L)/C]+[(X_1'+X_2')/Co] \quad (6)$$

where V is the travelling speed of the train 41, C is the propagation speed of the ultrasonic wave signal through the rail, and Co is the propagation speed of the ultrasonic wave signal through air.

Figure 11:
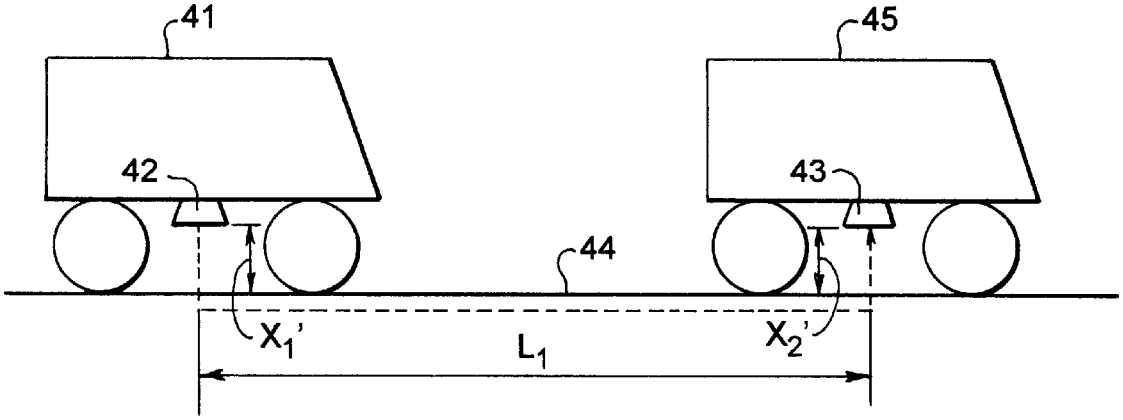
FIG. 11 is a diagram for explaining the difference in the effect of the transmitter and receiver installation arrangement for the present embodiment and the conventional construction.

Moreover, in the case of measuring the distance between trains, then when the train 41 on the transmitter side and a train 45 on the receiver side are both stopped, and a distance $L_1$ as shown in FIG. 11 is measured, the resultant sensitivity is given by the following equation (7):

$$\Delta T/T=[(L_1/C)/(A+(L_1/C))]\times(\Delta L_1/L_1) \quad (7)$$

where $A=(X_1'+X_2')/Co$, representing the propagation time through the air.

Therefore, in the case where the propagation time A is equal to the propagation time $(L_1/C)$ through the rail 44, then equation (7) becomes the following equation (8):

$$\Delta T/T=(\Delta L_1/L_1)/2 \quad (8)$$

Consequently, sensitivity (ΔT/T) drops to 50%.

Moreover, with the mounting configuration shown in FIG. 10, the time required for transmission and reception of the ultrasonic wave is increased so that it takes time from when the ultrasonic wave is transmitted until the information necessary for travel control is received. There is thus the disadvantage that the speed of communicating the information is limited.

On the other hand, with the present embodiment, since the time corresponding to the propagation time A can be neglected, then $\Delta T/T=(\Delta L_1/L_1)$ and there is thus no drop in sensitivity.

With the present embodiment, a calibration signal generated at a constant period from a calibration signal generating source set up for example on the ground side, is respectively received simultaneously by the antennas 6, 20, and the calibration signal is output from the calibration signal receiving circuits 5, 19 to the two timing signal generating circuits 2, 11. As a result, the frequency divided output signals $Q_1$~$Q_6$ of the counters 2A, 11A are all reset, after which the counting of the counters 2A, 11A is simultaneously restarted by the rising edge of the calibration signal. In this way, any deviation in synchronism between the first and second timing signal generating circuits 2, 11 is corrected.

Consequently, this has the effect that the reliability of the accuracy of synchronization of the transmission side and the reception side timing of the ultrasonic wave between the trains can be improved. Moreover, the measurement accuracy of the propagation time of the ultrasonic wave can be increased.

A method is also possible where respective clocks are provided on the ultrasonic wave transmission side and reception side, and transmission time information is transmitted at the transmission side, and the transmission time is then measured at the reception side using this transmission time information and related reception time information. In this case, the calibration signal output from the calibration signal generating source can serve as a reference time signal, and when this reference time signal is received by the transmission side and the reception side, the time of the respective clocks can be corrected to thereby carry out calibration of any deviation in synchronism. Moreover, the calibration signal generating source may be located on either the transmission side train or the reception side train. The proviso is that in either case, the calibration signal is received simultaneously at the transmission side and the reception side.

Next is a description of a second embodiment of the present invention.

With the second embodiment, the relative speed of the trains A and B is measured as the information necessary for train travel control, and the speed of the train A on the ultrasonic wave transmission side is computed based on this relative speed. The circuit configuration of the second embodiment is the same as that of the first embodiment, except that the computational processing operation of the signal processing circuit 13 is different, there being the functions of a relative speed computing device and a transmission side speed computing device incorporated as software.

Figure 12:
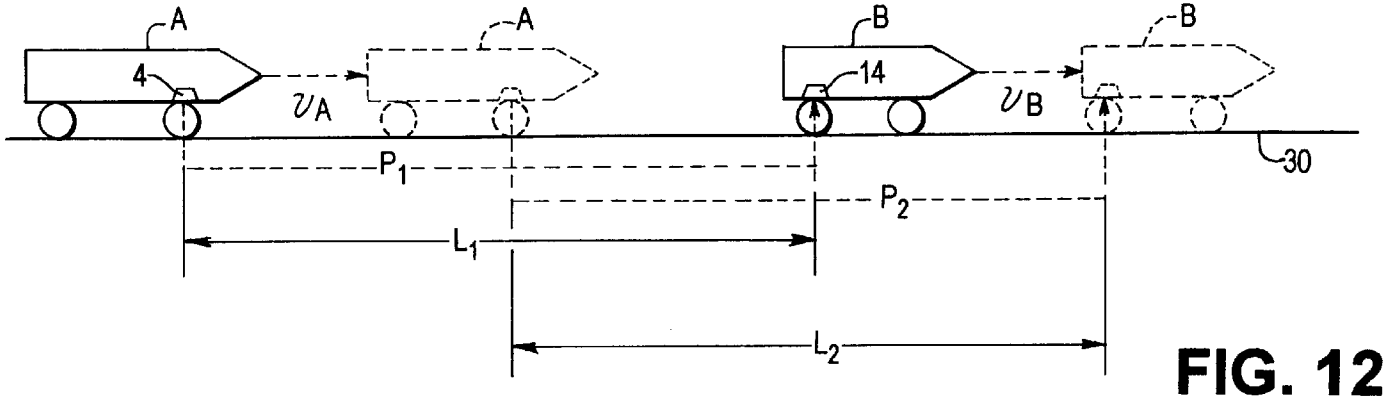
FIG. 12 is a diagram for explaining the operation of an other embodiment according to the present invention.
Figure 13:
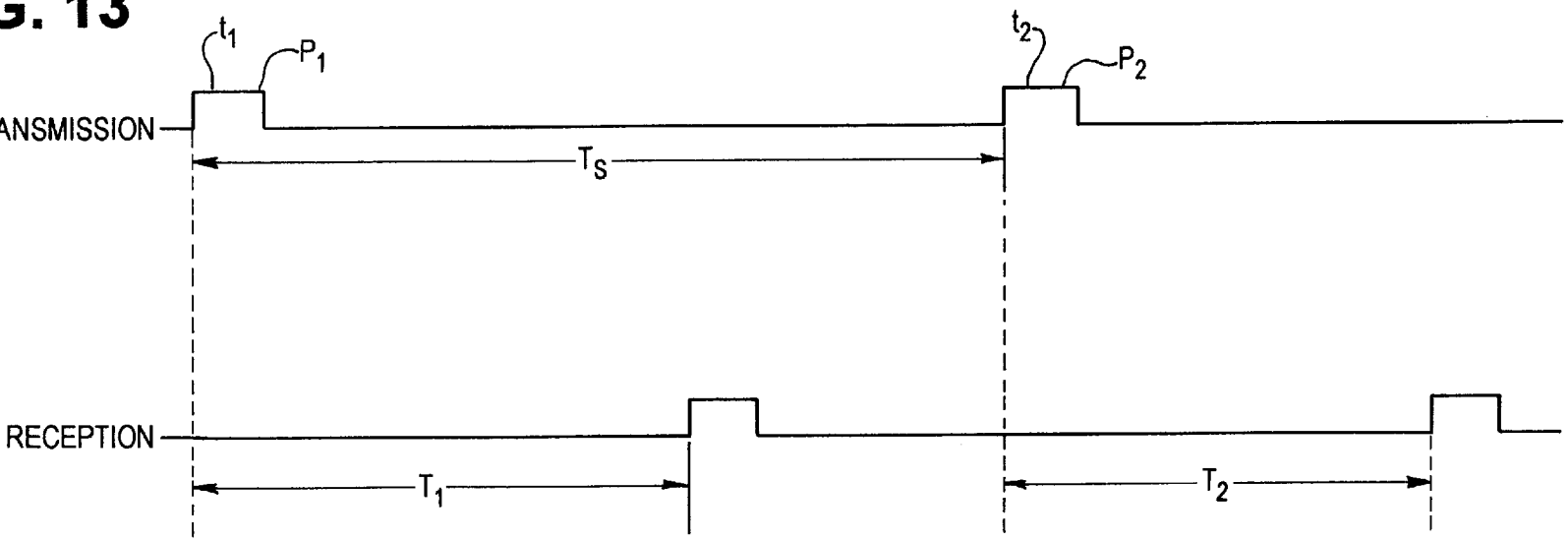
FIG. 13 is a time chart for signal transmission and reception in the other embodiment.

Consequently, hereunder only the computational processing operation for the relative speed and the transmission side train speed will be explained, with reference to FIG. 12 and FIG. 13.

An ultrasonic wave signal $P_1$ transmitted at a time $t_1$, from the train A located at the position indicated by the solid lines is received after a time $T_1$ by the train B located at the position indicated by the solid lines. Similarly, at a time $t_2$ after elapse of time Ts from the time $t_1$, an ultrasonic wave signal $P_2$ transmitted from the train A located at the location indicated by the dotted lines is received after a time $T_2$ by the train B located at the position indicted by the dotted lines.

A distance $L_1$ between the trains A, B at the time $t_1$ is expressed by the following equation (9) where $v_B$ is the speed of the train B:

$$L_1+\int_{t1}^{t1+T1} v_B(t)\,dt = C\cdot T_1 \quad (9)$$

The distance $L_2$ between the two trains at the next transmission time $t_2$ is expressed by the following equations (10), (11), where $v_A$ is the speed of the train A.

$$L_2 = L_1+\int_{t1}^{t1+Ts} v_B(t)\,dt-\int_{t1}^{t1+Ts} v_A(t)\,dt \quad (10)$$

$$L_2+\int_{t2}^{t2+T2} v_B(t)\,dt = C\cdot T_2 \quad (11)$$

If the average speed of the train B during transmission and reception of the signal $P_1$ is $v_{B1}$, and the average speed of the train B during transmission and reception of the signal $P_2$ is $v_{B2}$, then the difference between the time $T_1$ from transmission to reception of the signal $P_1$ and the time $T_2$ from transmission to reception of the signal $P_2$ is expressed by the following equation (12) derived from equations (9)~(11):

$$\begin{aligned} T_2-T_1 &= \frac{1}{C}\left\{L_2+\int_{t2}^{t2+T2} v_B(t)\,dt - L_1-\int_{t1}^{t1+T1} v_B(t)\,dt\right\} \quad (12)\\ &= \frac{1}{C}\left\{L_1+\int_{t1}^{t1+Ts} v_B(t)\,dt-\int_{t1}^{t1+Ts} v_A(t)\,dt + \int_{t2}^{t2+T2} v_B(t)\,dt - L_1-\int_{t1}^{t1+T1} v_B(t)\,dt\right\}\\ &= \frac{1}{C}\{Ts(V_B-V_A)+T_2v_{B2}-T_1v_{B1}\} \end{aligned}$$

where $V_A$ and $V_B$ denote the average speed of the trains A and B during the period from transmission of the signal $P_1$ to transmission of the signal $P_2$.

Consequently, $V_B-V_A$ is the average relative speed of the trains A and B, and is computed by the following equation (13):

$$V_B-V_A=[T_2(C-v_{B2})-T_1(C-v_{B1})]/T_S \quad (13)$$

Here, when $C>>v_{B1}$, $v_{B2}$ then this becomes the following approximation:

$$V_B-V_A\approx C\cdot(T_2-T_1)/T_S \quad (14)$$

From equation (14) the average relative speed of the trains A, B, being the information necessary for train travel control, can be known by measuring the ultrasonic wave transmission to reception times $T_1$, $T_2$.

Moreover when judgment is only as to whether or not the trains A, B are close, this judgment can be made as follows from the change in the difference $(T_2-T_1)$ between the time $T_2$ from transmission to reception of the signal $P_2$ and the time $T_1$ from transmission to reception of the signal $P_1$.

That is to say, when $T_2-T_1>0$, then the train A is becoming more distant from the train B. When $T_2-T_1=0$, the distance between the trains A and B is not changing. When $T_2-T_1<0$ then the train A is becoming closer to the train B.

Moreover, the average speed $V_B$ of the train B can be computed as the average value of $v_{B1}$ and $v_{B2}$ (i.e. $(v_{B1}+v_{B2})/2$). Therefore, the average speed $V_A$ of the train A which transmits the ultrasonic wave signal can be computed on the train B reception side from the following equation (15):

$$V_A=V_B-C\cdot(T_2-T_1)/T_S \quad (15)$$

In the above manner, with the present embodiment, the average relative speed between the trains A and B and the average speed of the train on the transmission side, being the information necessary for travel control of trains A and B, can be computed on the ultrasonic wave reception side.

Next is a description of an embodiment for the case where the transmitting and receiving operations of the ultrasonic wave do not require synchronization between the transmission side and the reception side.

Figure 14B:
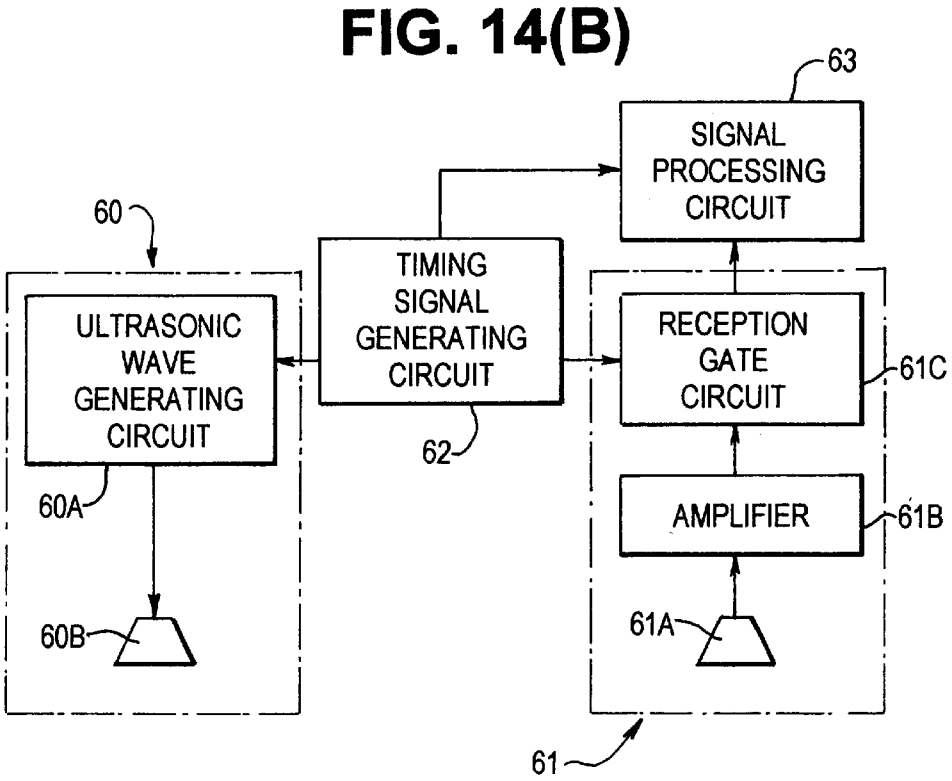
FIG. 14 is a schematic diagram of an apparatus of yet another embodiment according to the present invention, (A) being a schematic diagram of a reception side apparatus, and (B) being a schematic diagram of a transmission side apparatus.
Figure 14A:
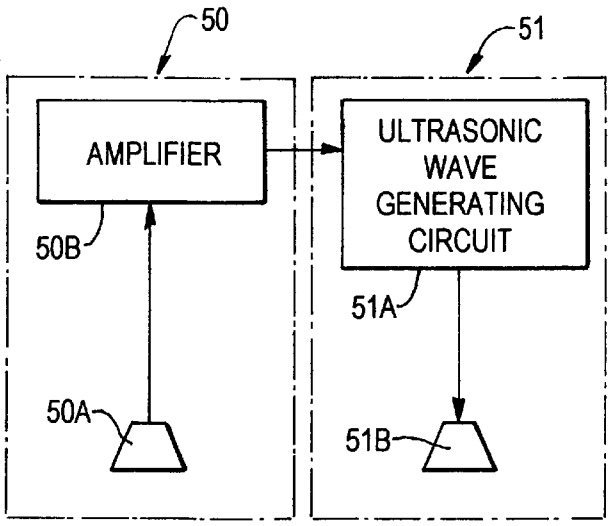

FIGS. 14(A) and (B) show the hardware configuration for this embodiment.

In FIG. 14, as shown by FIG. 14(A), a later described ultrasonic wave reception apparatus 50 for receiving ultrasonic wave signals from a train B, and an ultrasonic wave transmission apparatus 51 for generating an ultrasonic wave signal by means of an output from the ultrasonic wave reception apparatus 50, are mounted on a train A side. The ultrasonic wave reception apparatus 50 comprises a receiver 50A and an amplifier 50B. The ultrasonic wave transmission apparatus 51 comprises an ultrasonic wave generating circuit 51A for generating an ultrasonic wave signal by means of an output from the amplifier 50B, and a transmitter 51B.

On the other train B side, as shown in FIG. 14(B) are mounted an ultrasonic wave transmission apparatus 60, an ultrasonic wave reception apparatus 61, a timing signal generating circuit 62, and a signal processing circuit 63.

The ultrasonic wave transmission apparatus 60 comprises an ultrasonic wave generating circuit 60A for generating an ultrasonic wave signal by means of a timing signal from the timing signal generating circuit 62, and a transmitter 60B. The ultrasonic wave reception apparatus 61 comprises a receiver 61A for receiving ultrasonic wave signals, an amplifier 61B, and a reception gate circuit 61C which opens a gate by means of a timing signal from the timing signal generating circuit 62. The signal processing circuit 63 generates information necessary for train travel control, based on a timing signal from the timing signal generating circuit 62, and a reception signal from the ultrasonic wave reception apparatus 61. The basic operation of these respective apparatus and circuits is approximately similar to that for the apparatus and circuits of the first embodiment, and hence detailed description is here omitted.

Figure 15:
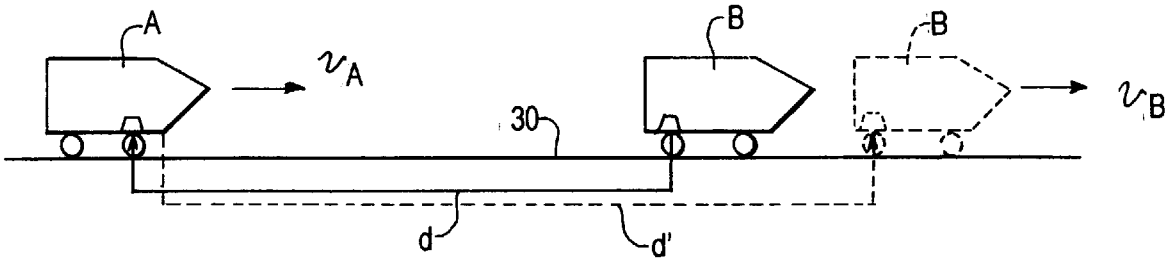
FIG. 15 is a diagram for explaining the operation of the embodiment of FIG. 14.
Figure 16:
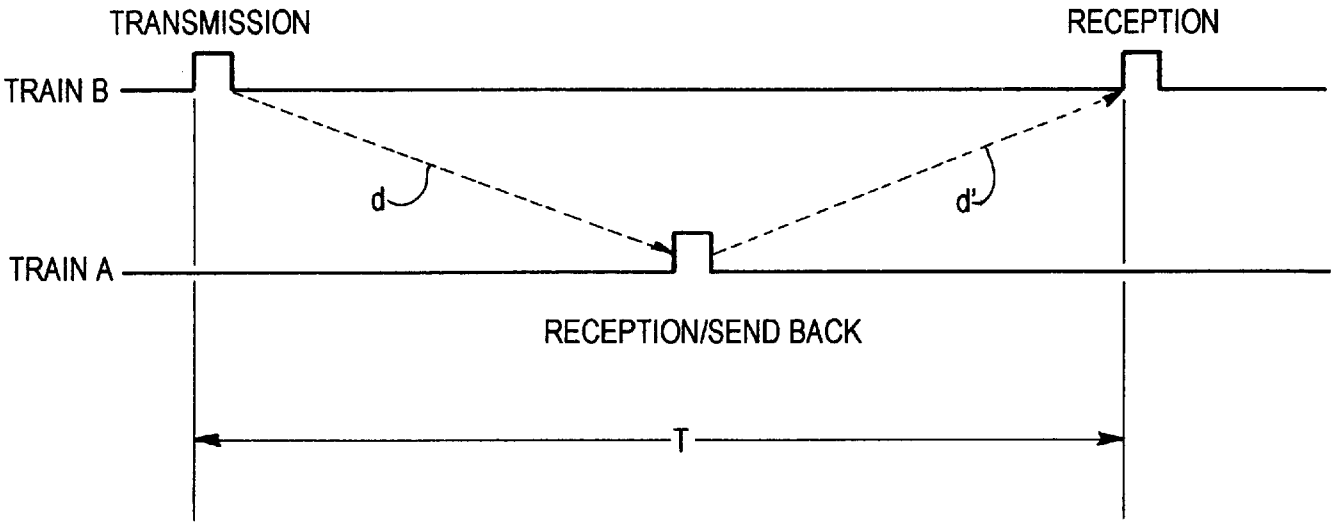
FIG. 16 is a time chart for signal transmission and reception in the embodiment of FIG. 14.

Next is a description of the transmission and reception operation for the ultrasonic wave signal in the present embodiment, with reference to FIG. 15 and FIG. 16.

With this embodiment, the ultrasonic wave signal is transmitted from the transmitter 60B of the ultrasonic wave transmitting apparatus 60 via the rail 30 (over the distance d shown by the solid line in FIG. 15) on the side of the front train B travelling for example at a speed $v_B$ to the rear train A travelling at a speed $v_A$. When the ultrasonic wave signal is received by the receiver 50A on the train A side, this is amplified by the amplifier 50B and then output to the ultrasonic wave generating circuit 51A of the ultrasonic wave transmission apparatus 51. As a result, an ultrasonic wave signal from the transmitter 51B is sent back to the train B side via the rail 30 (over the distance d' shown by the dashed line in FIG. 15) without a time delay from reception of the ultrasonic wave signal. At the train B side, the sent back ultrasonic wave signal is received by the receiver 61A, and amplified by the amplifier 61B and then input to the signal processing circuit 63 via the reception gate circuit 61C which has the gate opened by means of the timing signal. A transmission time T (refer to FIG. 16) of this ultrasonic wave signal is measured by the signal processing circuit 63, to thereby generate information necessary for travel control.

Here, in the case where the transmission speed of the ultrasonic wave signal is sufficiently larger than the speeds $v_A$ and $v_B$ of the trains A and B, then the distance L between the trains A and B is expressed by the following equation (16):

$$L=C\cdot T/2 \quad (16)$$

where T is the transmission time from transmission to reception of the ultrasonic wave signal by the train B side.

In the case where the speed of the trains A and B is to be considered, then if the speeds $v_A$, $v_B$ of the trains A, B do not change during the transmission of the ultrasonic wave signal, the distance L at the time when the train B transmits the ultrasonic wave signal can be expressed by the following equation (17):

$$2L=(C-(v_B-v_A))T \quad (17)$$

Here $v_B-v_A$ is the relative speed of the trains A and B. This relative speed $(v_B-v_A)$ can be measured as described before.

If the construction is as described above where an ultrasonic wave signal is transmitted from one train B side and is received on the other train A side, and the ultrasonic wave signal is then sent back without delay and is received on the train B side, and computational processing is then carried out based on the resultant transmission time T, then it is not necessary for the transmission and reception operations for the ultrasonic wave signal at the train A side and the train B side to be synchronized with each other. There are thus advantages such as the simplification of circuit construction.

FIG. 17 shows another embodiment.

FIG. 17 is an example for where travel control of the train on the other side is carried out based on the measurement results.

Figure 17B:
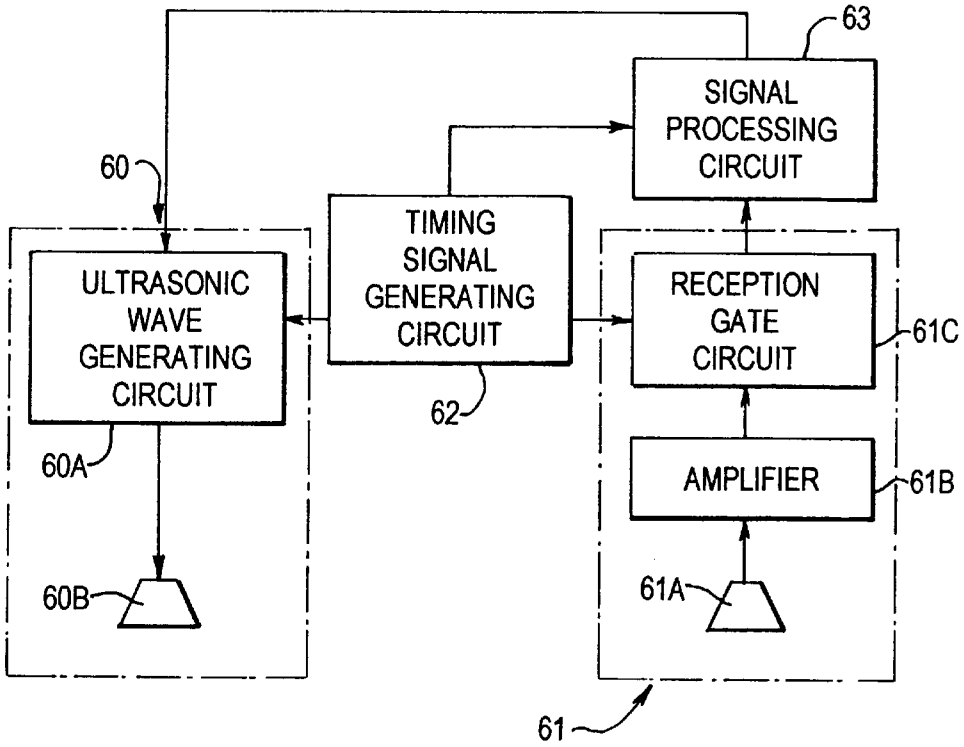
FIG. 17 is a schematic diagram of an apparatus of yet another embodiment according to the present invention, (A) being a schematic diagram of a reception side apparatus, and (B) being a schematic diagram of a transmission side apparatus.
Figure 17A:
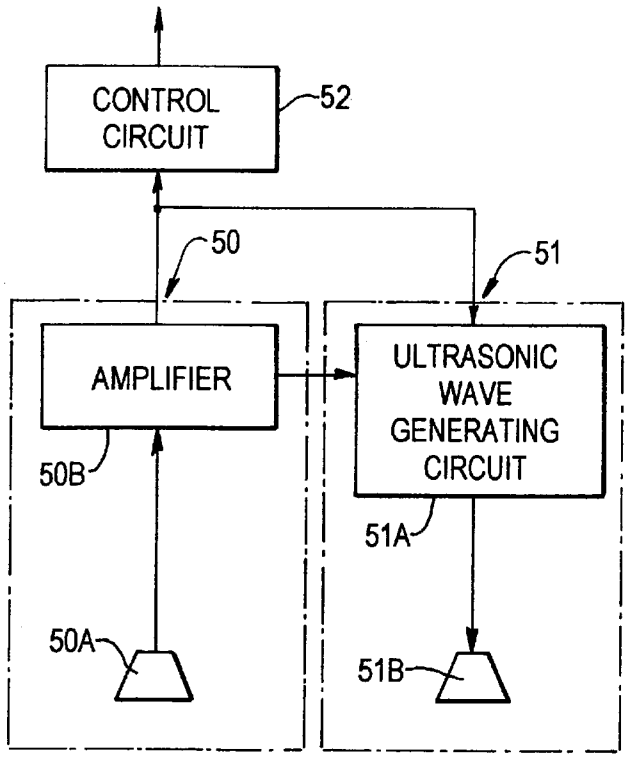

In FIG. 17 with this embodiment, a control circuit 52 for executing travel control of a train A based on a control signal transmitted from a train B side is provided on the train A side as shown in FIG. 17(A) in addition to the construction shown in FIG. 14. Moreover, on the train B side as shown in FIG. 17(B), the construction is substantially the same as the construction shown in FIG. 14, with the addition to a signal processing circuit 63', of a function for generating a control signal for the train A side based on computational processing results, this control signal being transmitted from an ultrasonic wave transmitting apparatus 60. Consequently, the signal processing circuit 63' incorporates the function of a transmission device for transmitting a control signal to the other side moving body.

Figure 18:
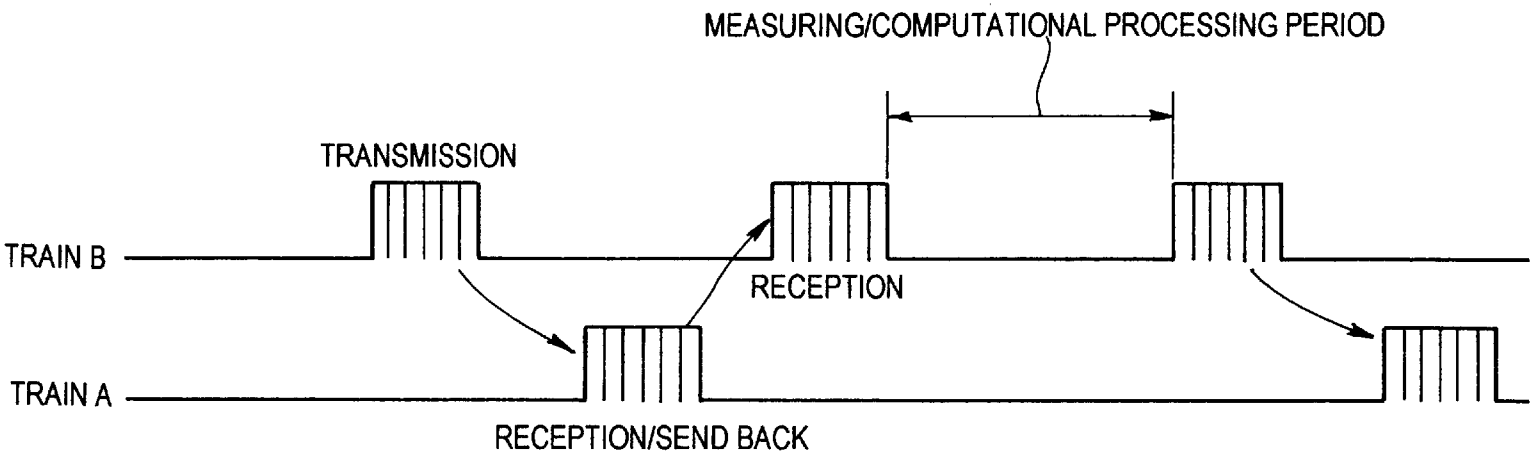
FIG. 18 is a time chart for controlling the operation of the embodiment of FIG. 17.

Next is a description of the operation, with reference to the time chart of FIG. 18.

The train B side transmits via the rail 30, a control signal serving as a command code (for example a command for travelling speed, acceleration, deceleration or stopping etc.) for controlling travel of the train A side based on a previous measurement and computation result. The train A side receives this and sends back a signal without delay, and also inputs the control signal to the control circuit 52 where it is decoded and the command code deciphered. Control outputs are then generated for respective machines, corresponding to the command to thereby control the travel conditions. At the train B side, the sent back signal from the train A side is received, and information for the next control command which is necessary for travel control of the train A is generated based on the measurement of the transmission time from transmission to reception, and the measurement results, and a control signal is again transmitted to the train A side. By repeating this operation, travel of the train A is controlled from the train B side.

With the construction as described above, then if the train side where measurement is carried out is the front train, then the rear train, that is the other side can be controlled from the front train to thereby carry out collision avoidance control or tracking control.

With the abovementioned respective embodiments, the constriction is such that the front train generates the information necessary for travel control of the trains. However needless to say, the construction may be such that the information necessary for travel control of the trains can be generated at the rear train side, to thereby control travel of the front train. Moreover, the moving bodies are not limited to trains. Furthermore, regarding the position where the transmitter and receiver are located, in the case of the transmitter, when the signal is transmitted for example to the front moving body this is preferably at the foremost part of the rear moving body, while when this is transmitted to the rear moving body this is preferably at the rearmost part of the front moving body. Moreover, in the case of the receiver, when the signal is received from the front moving body, this is preferably at the foremost part of the rear moving body, while when the signal is received from the rear moving body, this is preferably at the rearmost part of the front moving body. This is because in the case for example where the moving body is a train or the like, then if its wheels are in the transmission path for the ultrasonic wave signal, there is the possibility that the ultrasonic wave being transmitted or received will be attenuated by these wheels.

With the invention as described above, moving body travel control can be achieved with only communication between moving bodies and without communication with the ground side. As a result, direct control at a moving body unit is possible without intervention of the ground, and hence the flexibility of the operating control of the moving body and control system maintainability are improved. Furthermore, by mounting the transmission face of the transmitter and the receiving face of the receiver in direct contact with the mechanical elements comprising metal bodies of the moving body, then transmission losses occurring in the transmission path of the ultrasonic wave can be decreased and a reduction in measurement sensitivity prevented.

By application to the operating control of a train, then a decentralized control system depending on train units is possible, rather than the centralized control system such as the fixed block system in the conventional train control. Hence flexibility of operating control of the train and control system maintainability are improved. Moreover, insulation treatment between the rails as with the conventional block system is not necessary. Furthermore, since contact resistance between the rail and the wheel is no longer relevant, there is no longer any concern with problems originating in poor contact and the like, and hence reliability of the control system can be improved.

Figure 19:
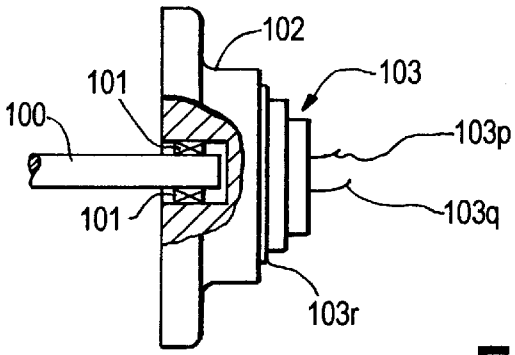
FIG. 19 is a diagram illustrating another mounting configuration for a transmitter and a receiver.
Figure 20:
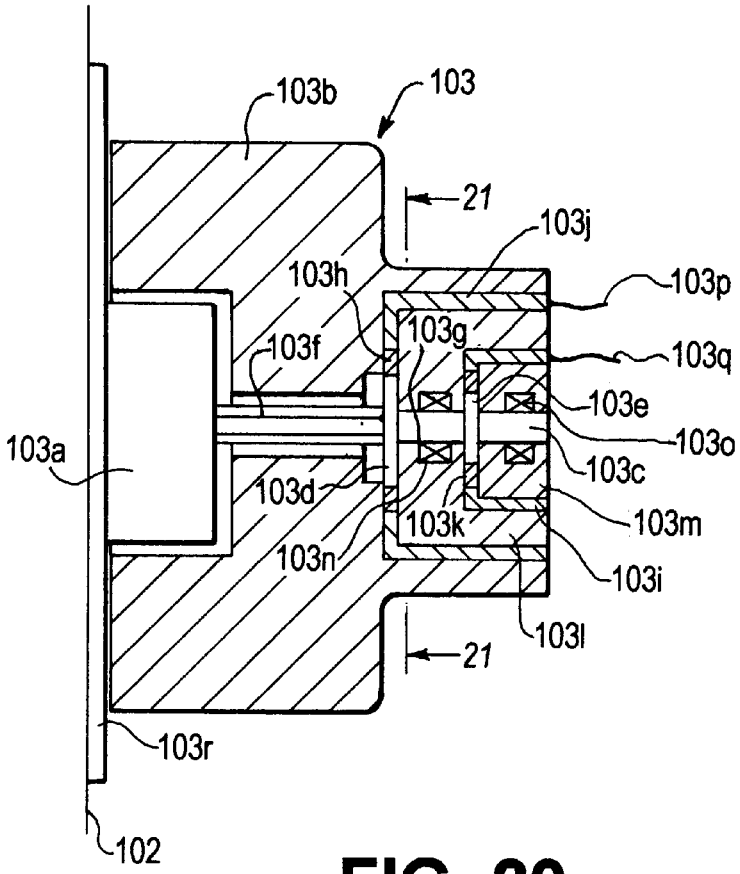
FIG. 20 is an enlarged cross-sectional view of the transmitter and receiver portion of FIG. 19.
Figure 21:
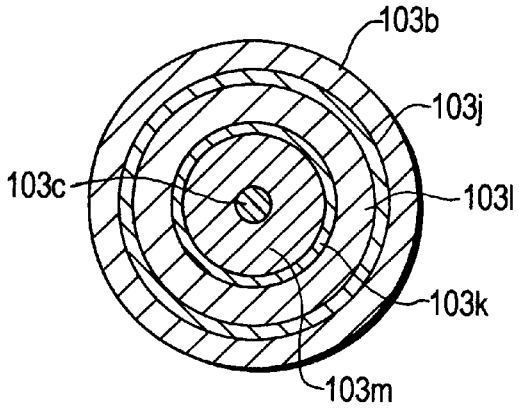
FIG. 21 is a cross-sectional view as seen in the direction of arrow A—A of FIG. 20.

As an arrangement for mounting the transmitter and the receiver, the construction as shown in FIG. 19 through FIG. 21 can also be considered. With this mounting arrangement, the example is given hereunder for the transmitter, however the arrangement is the same for the receiver.

In FIG. 19 through FIG. 21, a transmitter 103 is mounted on the side face of a wheel 102 which is mounted on an axle 100 by means of a bearing 101. In this case, the transmitter 103 is configured for example as shown in FIG. 20.

More specifically, a transmitter body 103*a* has a transmitting face thereof directly abutted against a side face of the wheel 102, and is secured by means of an attachment flange 103*r* with bolts or the like. An insulation body 103*b* covers the transmitter body 103*a* and the attachment flange 103*r* with a small gap between the transmitter body 103*a* and the attachment flange 103*r*. Two metal disk members 103*d*, 103*e* are provided on an axle 103*c* attached to the transmitter body 103*a*, in spaced apart relation and insulated from each other. The disk members 103*d*, 103*e* are each electrically connected to the transmitter body 103*a* via leads 103*f*, 103*g* provided along the axle 103*c*. The disk members 103*d*, 103*e* respectively contact approximately annular shaped outer electrode 103*j* and inner electrode 103*k* as shown in FIG. 21, via respective sliding contacts 103*h*, 103*i*. The outer electrode 103*j* and the inner electrode 103*k* are insulated from each other by means of an insulation body 103*l*. The axle 103*c* is axially supported on the insulation bodies 103*l*, 103*m* by means of bearings 103*n*, 103*o*. Furthermore, the insulation bodies 103*b*, 103*l*, 103*m* and the two electrodes 103*j*, 103*k* are all fixed relative to an adjacent fixed body (not shown in the figure). Consequently the transmitter body 103*a*, the axle 103*c* and the metal disk members 103*d*, 103*e* are able to rotate relative to the insulation bodies 103*b*, 103*l*, 103*m* and the two electrodes 103*j*, 103*k*, by means of the bearings 103*n*, 103*o*, and rotate as one with the wheel 102. In FIG. 19 and FIG. 20, 103*p*, 103*q* denote electrical supply leads connected to the outer and the inner electrodes 103*j*, 103*k*.

With such a mounting configuration for the transmitter and receiver, ultrasonic wave transmission can be carried out between the rail side and not via the bearing portion between the axle 100 and the wheel 102.

Now it will be apparent that in order to obtain a large amount of information for speed measurement, then a redundant configuration with a different frequency for ultrasonic wave transmission and reception is possible. Moreover, it will also be clear that in order to avoid interference between other trains, the frequencies used for the ultrasonic waves can be made different. Furthermore, a method may also be considered where the transmission and reception of information signals and the like is carried out via the rails using a coil as an antenna.

INDUSTRIAL APPLICABILITY

With the present invention, transfer of information necessary for travel control between moving bodies is possible without involving the ground side, and hence flexibility and maintainability of a moving body operating control system can be improved. Hence industrial applicability is significant.

We claim:

1. A moving body control apparatus which carries out transfer of ultrasonic wave signals via a metal body transmission medium between bodies which are moving while separated from each other by a distance to thereby carry out travel control of said moving bodies, wherein said moving bodies are trains, said transmission medium comprises a rail for said trains, and said rotating bodies are wheels of said trains rotating on said rail, said apparatus comprising:

ultrasonic wave transmitting means for radiating an ultrasonic wave signal towards said rail, said ultrasonic wave transmitting means being provided on one of said trains and incorporating a transmitter;

ultrasonic wave receiving means for receiving an ultrasonic wave signal via said rail, said ultrasonic wave receiving means incorporating a receiver; and information generating means for generating information necessary for travel control of said one of said trains based on the received ultrasonic wave signal provided on the other of said trains;

wherein said transmitter and receiver are directly mounted on said wheels rotating on said rail;

wherein said transmitter of said ultrasonic wave transmitting means directly transmits the ultrasonic wave signal towards said rail via a wheel provided on one of the trains and rotating on said rail, and said receiver of said ultrasonic wave receiving means directly receives the ultrasonic wave signal from said rail via a wheel provided on said other of said trains and rotating on said rail; and wherein:

a transmission face of said transmitter and a reception face of said receiver are each mounted so as to be in contact with the side face of a wheel of a respective one of said trains; and two metallic disks having a space therebetween which are insulated from each other and electrically connected to said transmitter via a leading wire are mounted on a supporting axle provided on the rear face of said transmission face; and two metallic disks having a space therebetween which are insulated from each other and electrically connected to said receiver via a leading wire are mounted on a supporting axle provided on the rear face of said reception face; and each said supporting axle is axially and rotatably supported via a bearing mounted on a fixed portion on the vehicle side and each two of said disks are electrically in contact via sliders with respective ring electrodes which are mounted on said fixed portion being insulated from each other.

2. A moving body control apparatus according to claim 1, wherein there is provided synchronizing means for synchronizing said ultrasonic wave transmitting means and said ultrasonic wave receiving means with each other.

3. A moving body control apparatus according to claim 2, wherein said synchronizing means incorporates: first timing signal generating means for generating a first timing signal for controlling the transmission timing of said ultrasonic wave transmitting means provided on said one moving body side, and second timing signal generating means for generating a second timing signal synchronized with said first timing signal, for controlling the reception timing of said ultrasonic wave receiving means provided on said other moving body side.

4. A moving body control apparatus according to claim 3, wherein there is provided calibration means for respectively calibrating any deviation in synchronization of the respective timing signals of said first and second timing signal generating means.

5. A moving body control apparatus according to claim 4, wherein said first and second timing signal generating means each comprise: a clock signal generator, a counter which divides the clock signals of said clock signal generator to produce a plurality of frequency divided outputs, NOT circuits which respectively carry out NOT operations on said plurality of divided outputs, and an AND circuit which carries out a logical product operation on the outputs from the respective NOT circuits to generate said timing signals, and said calibration means each comprise; an antenna for receiving a calibration signal from a calibration signal generating source, and a calibration signal receiving circuit for outputting a reset signal for forcibly resetting the respective counter by input of a calibration signal received by said antenna.

6. A moving body control apparatus according to claim 1, wherein said information generating means comprises: time measuring means for measuring a time from transmission to reception of an ultrasonic wave signal, and distance computing means for computing as said information necessary for travel control, a distance between moving bodies, based on a measurement value of said time measuring means.

7. A moving body control apparatus according to claim 6, wherein said information generating means comprises relative speed computing means for computing a relative speed between moving bodies based on a change pattern for the distance between moving bodies computed by said distance computing means.

8. A moving body control apparatus according to claim 6, wherein said other moving body incorporates an other ultrasonic wave transmitting means separate from said ultrasonic wave transmitting means of said one moving body, said information generating means incorporates a reception side speed computing means for computing the speed of said other moving body on the reception side, based on a time from transmission of an ultrasonic wave signal from said other ultrasonic wave transmitting means until reception by the ultrasonic wave receiving means, and the distance between the moving bodies is computed based on a computed output value of said reception side speed computing mean and a measured value of said time measuring means.

9. A moving body control apparatus according to claim 8, wherein said information generating means incorporates transmission side speed computing means for computing the speed of said one moving body on the transmission side based on a relative speed computed by said relative speed computing means and a speed of said other moving body computed by said reception side speed computing means.

10. A moving body control apparatus according to claim 1, wherein said ultrasonic wave transmitting means of one moving body and said ultrasonic wave receiving means of the other moving body are not synchronized.

11. A moving body control apparatus according to claim 10, wherein said two moving bodies each incorporate ultrasonic wave transmitting means and ultrasonic wave receiving means, the construction being such that when the ultrasonic wave receiving means on said one moving body side receives an ultrasonic wave signal transmitted from said other moving body side then without delay, the ultrasonic wave signal is sent back to said other moving body side, and the sent back signal is received by the ultrasonic wave receiving means on the other moving body side, and said information generating means generates the information necessary for travel control of a moving body based on the time from when the ultrasonic wave is transmitted from the other moving body side until said sent back signal is received on the other moving body side.

12. A moving body control apparatus according to claim 1, wherein said other moving body incorporates transmission means for transmitting travel control information to the other side moving body based on information generated by said information generating means, and said one moving body side incorporates control means for generating travel control commands based on travel control information transmitted by said transmission means.

* * * * *